US009014609B2

(12) United States Patent
Suzuki et al.

(10) Patent No.: US 9,014,609 B2
(45) Date of Patent: Apr. 21, 2015

(54) FIXING DEVICE HAVING BASE TUBE WITH ROUGH SURFACE

(71) Applicants: Noboru Suzuki, Komaki (JP); Kei Ishida, Nagoya (JP); Takuji Matsuno, Ichinomiya (JP); Seiji Hiramatsu, Nagoya (JP)

(72) Inventors: Noboru Suzuki, Komaki (JP); Kei Ishida, Nagoya (JP); Takuji Matsuno, Ichinomiya (JP); Seiji Hiramatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/738,065

(22) Filed: Jan. 10, 2013

(65) Prior Publication Data

US 2013/0322938 A1 Dec. 5, 2013

(30) Foreign Application Priority Data

May 31, 2012 (JP) ..... 2012-124783

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
USPC ..... 399/329, 333
See application file for complete search history.

(56) References Cited

U.S. PATENT DOCUMENTS

| | | | | |
|---|---|---|---|---|
| 5,649,273 | A * | 7/1997 | Shimizu et al. | 399/329 |
| 6,144,832 | A * | 11/2000 | Nimura et al. | 399/328 |
| 6,748,192 | B2 * | 6/2004 | Izawa et al. | 399/329 |
| 7,389,079 | B2 * | 6/2008 | Narahara et al. | 399/329 |
| 8,107,871 | B2 * | 1/2012 | Finn et al. | 399/334 |
| 2006/0120778 | A1 * | 6/2006 | Aze et al. | 399/328 |
| 2010/0247169 | A1 * | 9/2010 | Hayashi | 399/302 |
| 2012/0051809 | A1 | 3/2012 | Miyauchi | |

FOREIGN PATENT DOCUMENTS

| | | | |
|---|---|---|---|
| JP | 2009288399 | A * | 12/2009 |
| JP | 2010204587 | A * | 9/2010 |
| JP | 2012-053105 | A | 3/2012 |

* cited by examiner

*Primary Examiner* — Clayton E LaBalle
*Assistant Examiner* — Leon W. Rhodes, Jr.
(74) *Attorney, Agent, or Firm* — Banner & Witcoff, Ltd.

(57) ABSTRACT

A fixing device includes: a flexible tubular member defining an internal space and extending in an axial direction; a first fixing member disposed within the internal space; and a second fixing member configured to nip the flexible tubular member in cooperation with the first fixing member. The flexible tubular member includes a metal base tube having an outer peripheral surface configured of a first area and a second area other than the first area in the axial direction. The first area has a 10-point average roughness of larger than 3 μm, and the second area has a 10-point average roughness of equal to or smaller than 3 μm.

6 Claims, 4 Drawing Sheets

FIXING DEVICE HAVING BASE TUBE WITH ROUGH SURFACE

CROSS REFERENCE TO RELATED APPLICATION

This application claims priority from Japanese Patent Application No. 2012-124783 filed May 31, 2012. The entire content of the priority application is incorporated herein by reference.

TECHNICAL FIELD

The present invention relates to a fixing device for thermally fixing a developing agent image onto a sheet.

BACKGROUND

There have been proposed a fixing device that includes a tubular member (fixing belt), a nip plate positioned in an internal space of the tubular member, and a backup roller providing a nip region for nipping the tubular member in cooperation with the nip plate. The tubular member is constituted by a base tube made from a metal, and a coating layer made from a fluorine resin formed over an outer peripheral surface of the base tube.

SUMMARY

However, the coating layer may be frictionally worn due to frictional contact with sheets and the backup roller. Particularly, in the coating layer, frictional wearing at a portion in contact with an edge portion of the sheet occurs faster than the frictional wearing at a remaining portion of the coating layer. The coating layer at the portion in contact with the edge of the sheet is scraped, so that the coating layer may be easily peeled off from the base tube in an axial direction thereof Thus, it is an object of the present invention to provide a thermal fixing device providing prolonged service life of the tubular member.

In order to attain the above and other objects, there is provided a fixing device including: a flexible tubular member defining an internal space and extending in an axial direction; a first fixing member disposed within the internal space; and a second fixing member configured to nip the flexible tubular member in cooperation with the first fixing member. The flexible tubular member includes a metal base tube having an outer peripheral surface, the outer peripheral surface including a first area and a second area other than the first area in the axial direction, the first area having a 10-point average roughness of larger than 3 μm and the second area having a 10-point average roughness of equal to or smaller than 3 μm.

DETAILED DESCRIPTION

First, a general configuration of a laser printer 1 that is provided with a fixing device 8 according to an embodiment of the present invention will be described with reference to FIG. 1.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
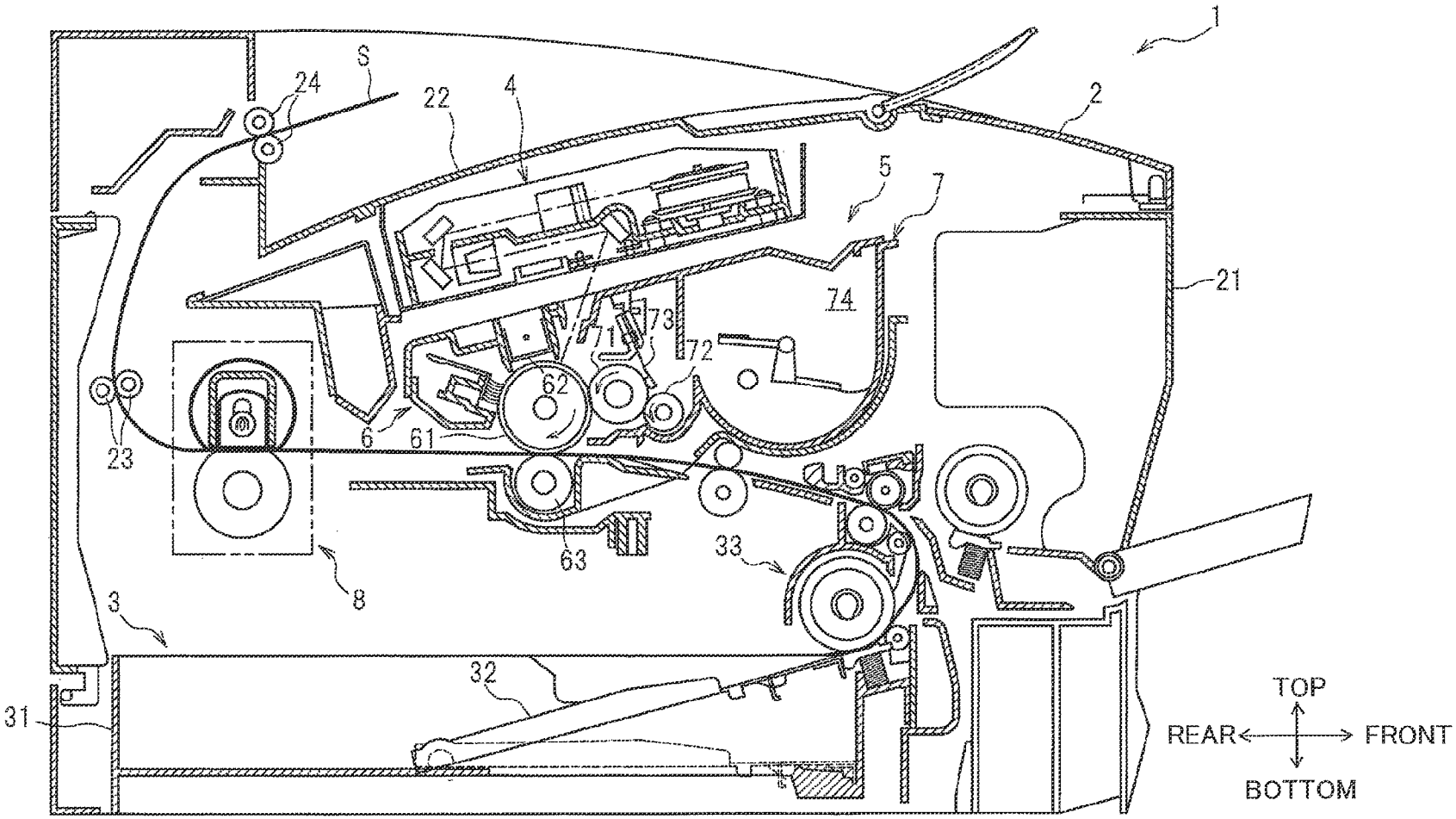
FIG. 1 is a schematic cross-sectional view showing a structure of a laser printer having a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 8 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S and a sheet supplying mechanism 33. Each sheet S accommodated in the sheet supply tray 31 is directed upward by the lifter plate 32 and supplied toward the process cartridge 5 (between a photosensitive drum 61 and a transfer roller 63) by the sheet supplying mechanism 33. A path along which the sheet S is conveyed within the main frame 2 (sheet conveying path) is shown by a thick solid line in FIG. 1.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data, by which high speed scan a surface of the photosensitive drum 61 is exposed to light.

The process cartridge 5 is disposed below the exposure unit 4. The process cartridge 5 is detachably loadable in the main frame 2 through a front opening defined when the front cover 21 of the main frame 2 is opened.

The process cartridge 5 includes a drum unit 6 and a developing unit 7.

The drum unit 6 includes the photosensitive drum 61, a charger 62, and the transfer roller 63. The developing unit 7 is detachably mountable on the drum unit 6 and includes a developing roller 71, a supply roller 72, a thickness-regulation blade 73, and a toner accommodating portion 74 in which toner (developer) is accommodated.

In the process cartridge 5, after the surface of the photosensitive drum 61 is uniformly charged by the charger 62, the surface is exposed to the high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 and is carried on the developing roller 71 as a thin layer having a uniform thickness.

The toner borne on the developing roller 71 is supplied to the electrostatic latent image formed on the photosensitive drum 61, thereby forming a visible toner image on the surface of the photosensitive drum 61. Then, the sheet S is conveyed between the photosensitive drum 61 and the transfer roller 63, so that the toner image formed on the photosensitive drum 61 is transferred onto the sheet S.

The fixing device 8 is disposed rearward of the process cartridge 5. The toner image (toner) transferred onto the sheet S is thermally fixed on the sheet S while the sheet S passes through the fixing device 8. The sheet S on which the toner image is thermally fixed is then conveyed by conveying rollers 23 and 24, and discharged onto a discharge tray 22 formed on an upper surface of the main frame 2.

Next, a general structure of the fixing device 8 will be described with reference to FIG. 2.

Figure 2:
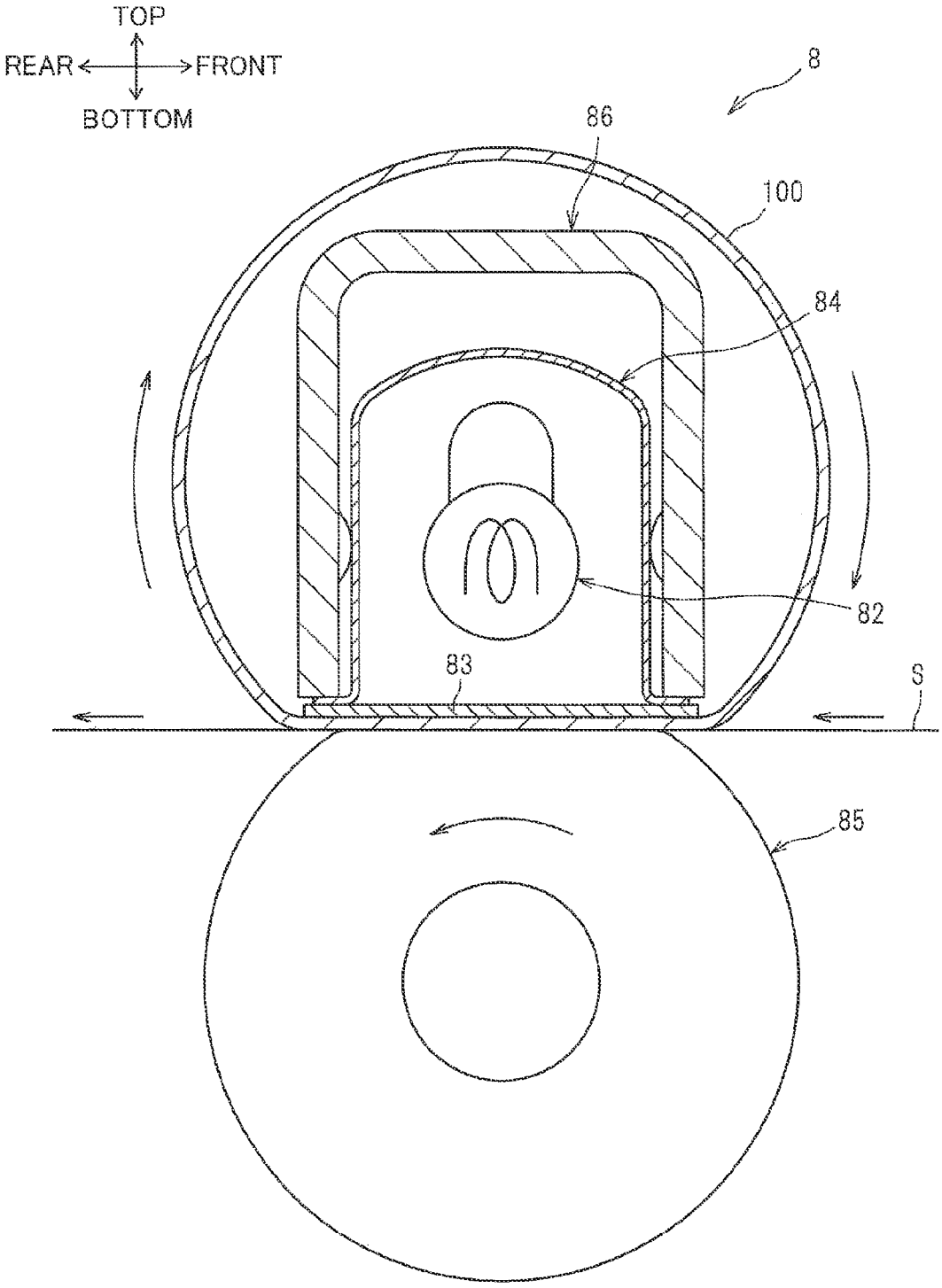
FIG. 2 is a schematic cross-sectional view showing a structure of the fixing device according to the embodiment.

As shown in FIG. 2, the fixing device 8 includes a tubular fusing film 100, a halogen lamp 82 as a heat source, a nip plate 83 as a first fixing member, a reflection plate 84, a pressure roller 85 as a second fixing member, and a stay 86.

The fusing film 100 is of an endless film (of a tubular configuration) having heat resistivity and flexibility. The fusing film 100 has an internal space within which the halogen lamp 82, the nip plate 83, the reflection plate 84 and the stay 86 are disposed. The fusing film 100 has widthwise end portions that are guided by guide members (not shown) so that the fusing film 100 is circularly movable.

The halogen lamp 82 is configured to generate radiation heat for heating the nip plate 83 and the fusing film 100 such that the toner on the sheet S can be heated. The halogen lamp 82 is positioned at the internal space of the fusing film 100 such that the halogen lamp 82 is spaced away from an inner surface of the nip plate 83 by a predetermined distance.

The nip plate 83 is a plate-shaped member and is heated by the radiation heat from the halogen lamp 82. The nip plate 83 is positioned such that an inner circumferential surface of the fusing film 100 is slidably movable with a lower surface of the nip plate 83. The nip plate 83 transmits the radiation heat from the halogen lamp 82 to the toner on the sheet S via the fusing film 100. For this purpose, the nip plate 83 is made from a material such as aluminum having a relatively high thermal conductivity.

The reflection plate 84 is adapted to reflect the radiant heat from the halogen lamp 82 toward the nip plate 83. As shown in FIG. 2, the reflection plate 84 is positioned at the internal space of the fusing film 100 to surround the halogen lamp 82, with a predetermined distance therefrom. The reflection plate 84 is configured into U-shape in cross-section and is made from a material, such as aluminum, having high reflection ratio regarding infrared ray and far infrared ray.

The pressure roller 85 nips the fusing film 100 in cooperation with the nip plate 83 for nipping the sheet S between the pressure roller 85 and the fusing film 100. The pressure roller 85 is disposed below the nip plate 83. The pressure roller 85 is rotationally driven by a drive motor (not shown) disposed in the main frame 2. By the rotation of the pressure roller 85, the fusing film 100 is circularly moved along the nip plate 83 because of the friction force generated between the pressure roller 85 and the sheet S, and between the sheet S and the fusing film 100.

The stay 86 is adapted to support the nip plate 83 via the reflection plate 84. The stay 86 receives pressure (load) applied from the pressure roller 85 to maintain rigidity of the nip plate 130. The stay 86 is disposed within the internal space of the fusing film 100 such that the stay 86 covers the reflection plate 84. For fabricating the stay 86, a highly rigid member such as a steel plate is folded into a substantially U-shape in cross-section in conformance with an outer profile of the reflection plate 84.

In the fixing device 8, the toner image on the sheet S can be thermally fixed thereon by heat and pressure applied while the sheet S passes between the pressure roller 85 and the fusing film 100.

<Detailed Configuration of Fusing Film>

Figure 3:
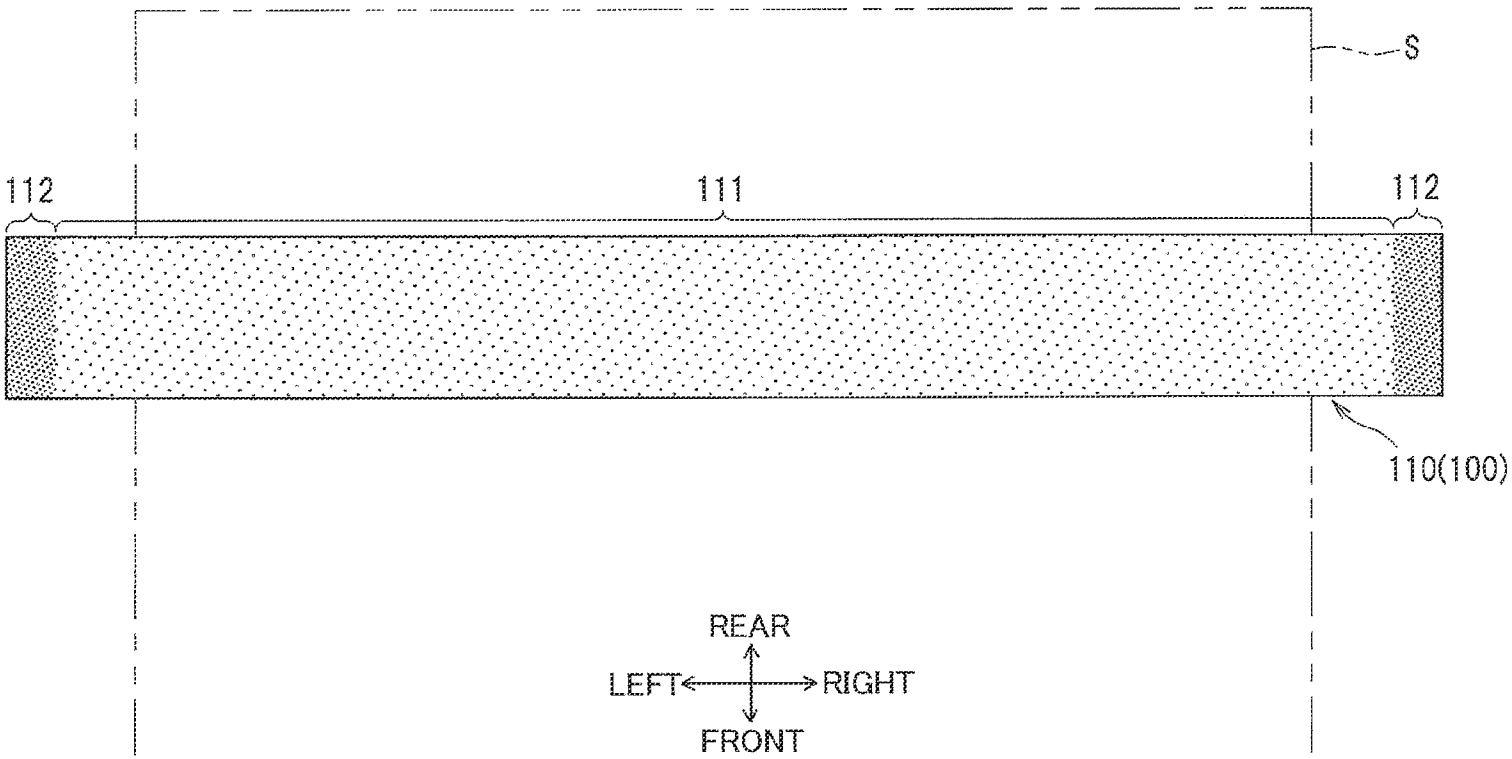
FIG. 3 is a plan view of a fusing film used in the fixing device according to the embodiment.
Figure 4:
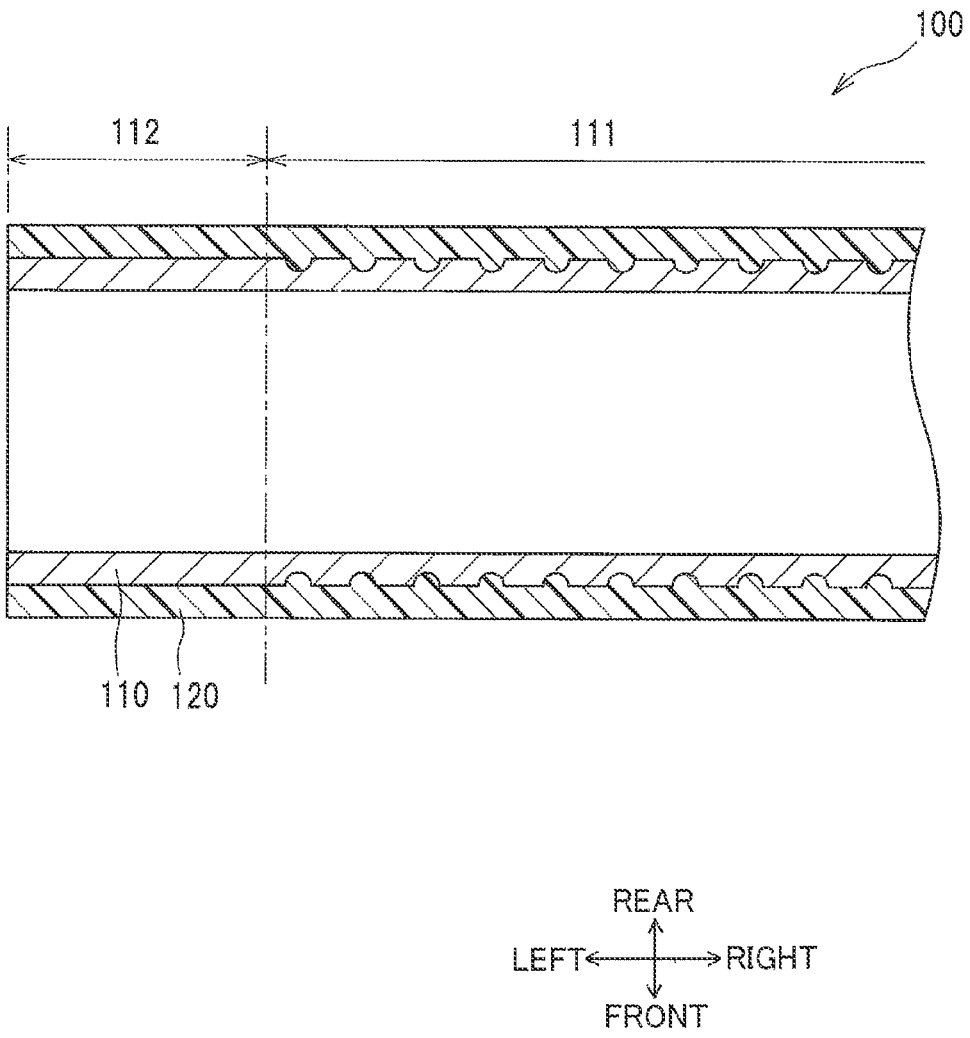
FIG. 4 is a vertical cross-sectional view of the fusing film of FIG. 4.

As shown in FIGS. 3 and 4, the fusing film 100 mainly includes a base tube 110 and a coating layer 120 formed on an outer peripheral surface of the base tube 110.

The base tube 110 is formed of a metal such as stainless steel, and has a cylindrical shape elongated in a left-right direction. The base tube 110 has, on its outer peripheral surface, a first region 111 and a pair of second regions 112 interposing the first region 111 in the left-right direction. The first region 111 has a surface roughness different from that of each second region 112.

The first region 111 is a region facing the sheet S conveyed between the fusing film 100 and the backup roller 85. In the present embodiment, the first region 111 is formed to have a width slightly larger than a width (length in the left-right direction) of the sheet S having a maximum size at which the laser printer 1 can perform printing (maximum size of sheet S that the fixing device 8 can convey), as indicated by two-dashed chain line in FIG. 3.

The second regions 112 are regions positioned outside the first region 111 in a width direction of the sheet S (left-right direction), more specifically, regions corresponding to both left and right end portions on the outer peripheral surface of the base tube 110.

As an example, the base tube 110 may be configured such that, assuming that a width (length in the left-right direction) of the base tube 110 is 238 mm, a width of the first region 111 is set to 226 mm, and a width of each of the pair of second regions 112 is set to 6 mm.

The first region 111 has a 10-point average roughness ($R_{zJIS}$) of more than 3 μm, and each second region 112 has a 10-point average roughness ($R_{zJIS}$) of equal to or less than 3 μm. The 10-point average roughness ($R_{zJIS}$) is a surface roughness parameter defined by Japanese Industrial Standard (based on JIS B 0601-2001) and will be simply referred to as "$R_{zJIS}$" hereinafter. In the present embodiment, for measuring $R_{zJIS}$, the present inventors have used a Roughness measuring machine: Surfcom 130A (TOKYO SEIMITSU). In the embodiment, the surface roughness of the outer peripheral surface of the base tube 110 becomes larger (coarser) toward its center (first region 111) from both left and right end portions thereof (second regions 112).

The $R_{zJIS}$ of the first region 111 is preferably larger than 3 μm but equal to or less than 5 μm, and $R_{zJIS}$ of each second region 112 is preferably equal to or larger than 1 μm but equal to or less than 3 μm. For example, the $R_{zJIS}$ of the first region 111 may be set to 3 μm, and $R_{zJIS}$ of each second region 112 may be set to 1 μm. Further, in the embodiment, the base tube 110 has an inner peripheral surface whose $R_{zJIS}$ is equal to or less than 1.6 μm.

The coating layer 120 is formed of a fluorine resin and covers the entire outer peripheral surface of the base tube 110, i.e., the first region 111 and the second regions 112. Formation of the fluorine resin coating layer 120 can increase detachability of the sheet S from the fusing film 100 during heat fixing. Further, the formation of the coating layer 120 prevents toner from adhering to the fusing film 100, which prevents degradation of image quality due to retransfer of the toner adhering to the fusing film 100 to the sheet S.

As described above, on the outer peripheral surface of the base tube 110, the first region 111 that faces the sheet S has a surface coarser than that of each of the second regions 112. Therefore, a contact area between the first region 111 and the coating layer 120 can be increased as illustrated in FIG. 4, resulting in an enhanced adhesion between the first region 111 and the coating layer 120. This can suppress the coating layer 120 contacting the sheet S from peeling off the base tube 110.

On the other hand, each of the second regions 112 positioned at the both ends of the base tube 110 has a surface smoother than that of the first region 111. This means that there is less surface irregularity at the both end portions of the base tube 110 that could ignite a crack, thereby suppressing cracks from being developed at the end portions of the base tube 110.

In this way, due to the depicted configuration of the present embodiment in which the first region 111 on the outer peripheral surface of the base tube 110 has a relatively coarser surface and the second regions 112 have a relatively smoother surface, peeling of the coating layer 120 and generation of cracks at the both end portions of the base tube 110 can be suppressed, thereby serving to prolonged service life of the fusing film 100.

Next, production methods of the fusing film 100 will be described. More specifically, described are two illustrative examples on how to produce the base tube 110 whose outer peripheral surface has a surface roughness that differs among regions (portions) thereon.

A first example of the production method employs a blasting process to form irregularities on the outer peripheral surface of the base tube 110. In other words, the blasting process is performed to make the outer peripheral surface of the base tube 110 coarser.

Specifically, a masking member is attached to both lateral end portions of the metal base tube 110 having an $R_{zJIS}$ of equal to or less than 3 μm on its entire outer peripheral surface. The masking member is made of a rubber, for example, and has a tubular configuration with its one end closed for completely covering portions corresponding to the second regions 112 of the base tube 110.

Then, the base tube 110 to which the mask member is attached is rotated, during which resin or metal beads are sprayed onto the outer peripheral surface (the portion corresponding to the first region 111 exposed outside) of the base tube 110 at a high speed. A material, size (diameter) and spraying speed of the bead are appropriately set such that the $R_{zJIS}$ of the first region 111 becomes larger than 3 μm. The beads sprayed at a high speed collide with the first region 111, thereby forming irregularities on the first region 111 to make the $R_{zJIS}$ of the first region 111 larger than 3 μm. The second regions 112 are completely covered (masked) by the masking member, and thus the $R_{zJIS}$ of the second regions 112 remains (or is maintained at) equal to or smaller than 3 μm.

With the application of such blasting process as described above, the base tube 110 can be produced such that the $R_{zJIS}$ of the first region 111 is more than 3 μm and $R_{zJIS}$ of each of the second regions 112 is equal to or less than 3 μm.

A second example of producing the base tube 110 employs an etching process to form irregularities on the outer peripheral surface of the base tube 110. That is, the etching process is performed to make the outer peripheral surface of the base tube 110 coarser.

Specifically, an etching mask is formed on the outer peripheral surface of the metal base tube 110 having an $R_{zJIS}$ of equal to or less than 3 μm on its entire outer peripheral surface. The mask is formed so as to completely cover the portions corresponding to the second regions 112 of the base tube 110 and to have, at a portion that covers a portion corresponding to the first region 111, a plurality of holes each having a diameter or a pattern that makes the $R_{zJIS}$ of the first region 111 more than 3 μm. Through these holes of the mask, a portion of the outer peripheral surface of the metal base tube 110 corresponding to the first region 111 is partially exposed to an etching treatment liquid.

Subsequently, the base tube 110 having the mask as described above is immersed in the treatment liquid for a predetermined time period. As a result, on the outer peripheral surface of the base tube 110, the portion that is exposed to the treatment liquid through the holes of the mask is dissolved and eroded, on its surface layer, to form concaves thereon. Accordingly, irregularities are formed on the first region 111, and the $R_{zJIS}$ of the first region 111 becomes more than 3 μm. The second regions 112 are completely covered (masked) by the mask, so that the $R_{zJIS}$ of the second regions 112 remains (or is maintained at) equal to or less than 3 μm.

After the predetermined time period has elapsed, the base tube 110 is removed from the treatment liquid. The mask may be removed from the outer peripheral surface of the base tube 110 as needed. Thus produced is the base tube 110 in which the $R_{zJIS}$ of the first region 111 is more than 3 μm and $R_{zJIS}$ of each of the second regions 112 is equal to or less than 3 μm.

Incidentally, in the production method using the blasting process, if the base tube 110 is thin, irregularities may be formed also on an inner peripheral surface of the base tube 110 due to collision of the beads with the outer peripheral surface. On the other hand, in the etching process, carrying out the processing so as not to allow the treatment liquid to flow into (contact) the inner peripheral surface of the base tube 110 prevents irregularities from being formed on the inner peripheral surface.

That is, the etching process has an advantage over the blasting process in terms of easiness in maintaining the surface roughness of the inner peripheral surface of the base tube 110. When the inner peripheral surface of the base tube 110 is smooth, a larger contact area can be ensured between the inner peripheral surface of the base tube 110 (fusing film 100) and the nip plate 83 than otherwise, allowing the nip plate 83 to efficiently transmit heat received from the halogen lamp 82 to the fusing film 100. Preferably, the $R_{zJIS}$ of the inner peripheral surface of the base tube 110 is equal to or less than 1.6 μm, as in the embodiment.

Various modifications and changes are conceivable.

The two second regions 112 on the left and right side of the base tube 110 have the same width in the left-right direction in the depicted embodiment, but may have widths different from each other.

Further, the first region 111 may have substantially uniform surface roughness, or alternatively, both left and right ends of the first region 111 may be made coarser than its center region so as to increase a contact area between both widthwise ends of the sheet S and the coating layer 120. Further, the second regions 112 may each be formed into a smooth surface having substantially no irregularities or into a surface having small irregularities.

Although the coating layer 120 is formed of a fluorine resin in the above embodiment, the coating layer 120 may be formed of a material having elasticity, such as rubber.

In the above embodiment, the first region 111 is formed by the blasting or etching process so as to have the $R_{zJIS}$ of more than 3 μm, and the second regions 112 are subject to masking during the blasting or etching process to have the $R_{zJIS}$ of equal to or less than 3 μm. However, the first region 111 may be formed by employing the base tube 110 whose entire outer peripheral surface has an $R_{zJIS}$ of more than 3 μm. Still alternatively, if the base tube 110 having the $R_{zJIS}$ of more than 3 μm is used, the second regions 112 may be formed by polishing the both end portions (portions corresponding to the second regions 112) of the base tube 110 such that the $R_{zJIS}$ of the second regions becomes equal to or less than 3 μm.

Further, instead of the nip plate 83, a guide member that guides the inner peripheral surface of the circularly-moving base tube 110 while supporting a ceramic heater as the claimed heat source may be employed as the claimed first fixing member. Further, instead of the backup roller 85, a belt-like backup member or a plate-like backup member that does not rotate may be used as the second fixing member.

Further, the sheet S can be an OHP sheet instead of a plain paper and a postcard.

Further, in the depicted embodiment, the present invention is applied to the monochromatic laser printer 1 as an example of image forming apparatus, but may also be applicable to a color laser printer. Further, a multifunction device having a scanning unit such as flat head scanner is also available as the claimed image forming apparatus.

While the invention has been described in detail with reference to the embodiments thereof, it would be apparent to those skilled in the art that various changes and modifications may be made therein without departing from the spirit of the invention.

What is claimed is:

1. A fixing device comprising:

a flexible tubular member defining an internal space and extending in an axial direction, the flexible tubular member including a metal base tube;

a first fixing member disposed within the internal space; and a second fixing member configured to nip the flexible tubular member in cooperation with the first fixing member, the base tube having an outer peripheral surface including a first area and a second area other than the first area in the axial direction, the first area having a 10-point average roughness of larger than 3 μm and being positioned at a center region of the outer peripheral surface of the base tube in the axial direction and the second area having a 10-point average roughness of equal to or smaller than 3 μm and being positioned at an end region of the outer peripheral surface of the base tube in the axial direction, wherein the flexible tubular member further includes a coating layer provided on an entirety of the outer peripheral surface of the base tube to cover both the first area and the second area in the axial direction.

2. The fixing device according to claim 1, wherein the coating layer is made of a fluorine resin.

3. The fixing device according to claim 1, wherein the base tube has an inner peripheral surface defining the internal space, the inner peripheral surface having a 10-point average roughness of equal to or smaller than 3 μm.

4. The fixing device according to claim 1, wherein the base tube is formed of a stainless steel.

5. The fixing device according to claim 1, wherein the flexible tubular member is an endless film.

6. The fixing device according to claim 1, wherein the first area of the outer peripheral surface of the base tube faces the second fixing member.

* * * * *